US005335908A

United States Patent [19]

Bamber

[11] Patent Number: 5,335,908

[45] Date of Patent: Aug. 9, 1994

[54] GOLF CLUB SHAFT

[76] Inventor: Jeffrey V. Bamber, 5023 Village Dr., Cincinnati, Ohio 45244

[21] Appl. No.: 999,094

[22] Filed: Dec. 31, 1992

[51] Int. Cl.[5] ..... A63B 53/10

[52] U.S. Cl. ..... 273/80 R; 273/80 B

[58] Field of Search ..... 273/80 R, 80 B, 80.6, 273/80.9, 167 E, 77 R, 77 A, 80.1, 80.2

[56] References Cited

U.S. PATENT DOCUMENTS

| | | | |
|---|---|---|---|
| 1,239,356 | 9/1917 | Cochrane et al. | 273/80 B X |
| 1,396,470 | 11/1921 | Taylor | 273/77 R |
| 1,528,017 | 3/1925 | Gammeter | 273/80 R X |
| 1,615,232 | 1/1927 | Pryde et al. | 273/80 R |
| 1,787,415 | 12/1930 | Washington | 273/167 E |
| 1,890,037 | 12/1932 | Johnson | 273/80 R |
| 1,917,795 | 7/1933 | Fetter | 273/80 R |
| 1,994,069 | 3/1935 | Fletcher | 273/80 B |
| 2,001,643 | 5/1935 | Wilcox | 273/80 B |
| 2,088,095 | 7/1937 | Sargent et al. | 273/167 E |
| 2,153,550 | 4/1939 | Cowdery . | |
| 2,169,774 | 8/1939 | Taylor | 273/77 R |
| 4,288,075 | 9/1981 | Kaugars et al. | 273/80 B |
| 5,094,454 | 3/1992 | Schering . | |
| 5,165,688 | 11/1992 | Schmidt et al. . | |

FOREIGN PATENT DOCUMENTS

| | | | |
|---|---|---|---|
| 13712 | of 1905 | United Kingdom | 273/80 R |
| 354416 | 8/1931 | United Kingdom | 273/80 R |
| 489638 | 10/1936 | United Kingdom | 273/80 R |
| 518699 | 3/1940 | United Kingdom . | |

*Primary Examiner*—Vincent Millin
*Assistant Examiner*—Sebastiano Passaniti
*Attorney, Agent, or Firm*—Jeffrey V. Bamber

[57] ABSTRACT

An improved aerodynamic golf club shaft is disclosed. The improved aerodynamic golf club shaft comprises a tube that has an exterior with a non-circular cross section. The golf club shaft may have an elliptical exterior cross section in one preferred embodiment. The golf club shaft has a leading edge that is on the half of the shaft aligned with the face of the golf club and a trailing edge on the half of the shaft aligned with the back of the club. A portion of the leading edge of the shaft has a smaller radius of curvature than the leading edge of a equivalently sized shaft having a circular cross section.

9 Claims, 3 Drawing Sheets

GOLF CLUB SHAFT

FIELD OF THE INVENTION

This invention relates to golf clubs, more particularly to golf club shafts. More particularly still, this invention relates to an improved aerodynamic golf club shaft.

BACKGROUND OF THE INVENTION

Currently, golf club shafts are hollow steel or graphite tubes that are relatively thick at the grip end of the golf club, and narrow as the clubhead is approached. Typically, current golf club shafts have a series of steps therein. The thickness of the shafts change to a narrower thickness at each step.

Golf club shafts must meet the requirements of the United States Golf Association Rules of Golf to be considered "legal" for tournament play. The USGA Rules require in Appendix II, Rule **4-1*b***, that the shaft be "so designed and manufactured that at any point along its length:

(i) it bends in such a way that the deflection is the same regardless of how the shaft is rotated about its longitudinal axis; and (ii) it twists the same amount in both directions.

This Rule is believed to be the reason that golf club shafts are currently of circular cross section. Since golf club shafts have previously been believed to require circular cross sections, there has been little opportunity to make golf club shafts more aerodynamic. Another reason golf club shafts are not made more aerodynamic is believed to be an underestimation of the amount of drag created by the shaft when a golf club is swung.

Thus, a need exists for an improved golf club shaft that conforms to the Rules of Golf and is more aerodynamic than current golf club shafts. In particular, a need exists for an improved golf club shaft that allows the golf club to be swung faster by the player with the same or less effort to create more power, and longer shots.

These and other objects of the present invention will be more readily apparent when considered in reference to the following description and when taken in conjunction with the accompanying drawings.

SUMMARY OF THE INVENTION

The present invention relates to an improved aerodynamic golf club shaft. The improved aerodynamic golf club shaft comprises a tube that has an exterior with a non-circular cross section.

The golf club shaft may have an elliptical exterior cross section in one preferred embodiment. The golf club shaft of several embodiments of the present invention is based on the following principle. The shaft has a leading edge that is on the half of the shaft aligned with the face of the golf club and a trailing edge on the half of the shaft aligned with the back of the clubhead. At least a portion of the leading edge of the shaft has a smaller radius of curvature than the leading edge of an equivalently sized conventional shaft having a circular cross section.

A non-limiting number of ways are disclosed of providing a golf club shaft with such a cross section, and still retaining the bending and flexing properties needed to conform to USGA specifications. These include: (1) slipping a hollow sheath having an elliptical exterior cross section onto a standard golf club shaft or other shaft having a circular cross section (i.e., retaining the sheath by friction fit); (2) connecting such a sheath at points spaced equally radially around a circular shaft; (3) adhering a material to the leading edge of a circular shaft; or (4) constructing a hollow shaft having an aerodynamically shaped cross section with walls having different wall thicknesses. These and other embodiments will be described in greater detail below.

BRIEF DESCRIPTION OF THE DRAWINGS

While the specification concludes with claims particularly pointing out and distinctly claiming the present invention, it is believed the invention will be better understood from the following description taken in conjunction with the accompanying drawings (some of which have been enlarged).

DETAILED DESCRIPTION OF THE INVENTION

Figure 1:
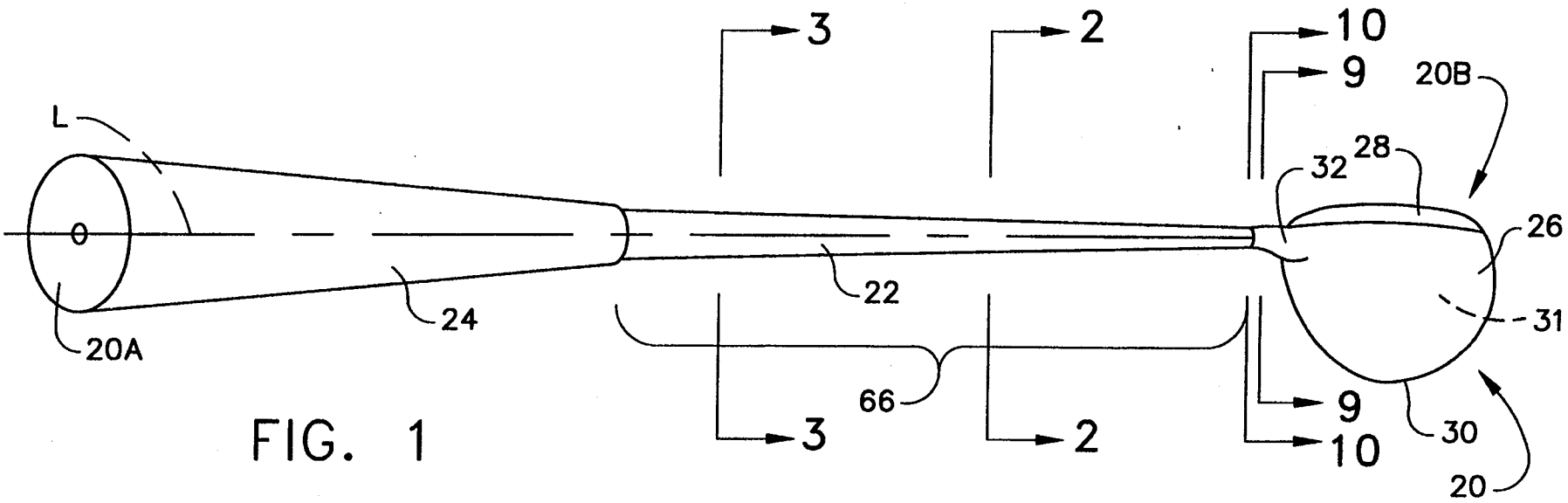
FIG. 1 is a perspective view of the golf club shaft of the present invention.

FIG. 1 is a perspective view of a golf club that is provided with the improved golf club shaft of the present invention.

The golf club 20 has a shaft 22, a grip 24, and a clubhead 26. The shaft runs from the grip end (or "upper end") 20A of the club to the clubhead end (or "lower end") 20B. The clubhead has a clubface 28 for striking the ball, a back 30 on the opposite side of the clubhead, a sole 31, and a hosel 32 where the clubhead end 20B of the shaft 22 is inserted into the clubhead 26.

Figure 2:
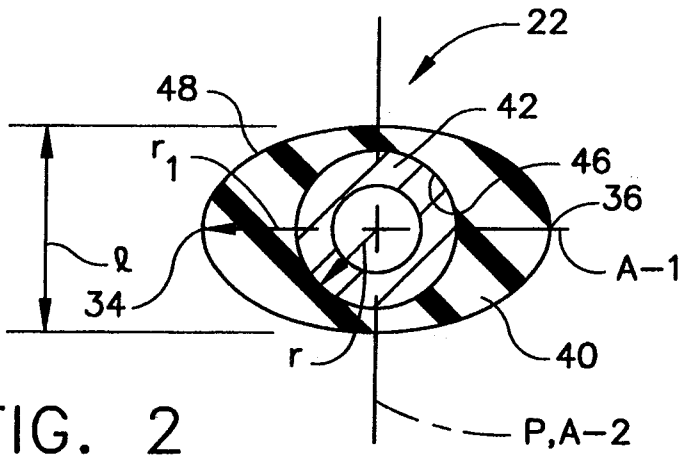
FIG. 2 is a cross sectional view of the golf club shaft of the present invention taken along line 2—2 of FIG. 1.

In the preferred embodiment of the present invention shown in FIG. 2, the golf club shaft 22 has an elliptical cross section. The shaft 22 can be divided in half by a plane, designated P, that runs generally parallel to the portion of the clubface 28 at the sole 31 of the clubhead 26. The golf club shaft 22 has a leading edge 34 that is on the half of the shaft aligned with the face 28 of the golf club. The shaft 22 has a trailing edge 36 on the half of the shaft aligned with the back of the clubhead 30. At least a portion of the leading edge 34 of the shaft has a smaller radius of curvature (designated rl) than the radius (designated r) of the leading edge of a shaft having an equivalently sized (i.e., thickness) circular cross section.

The orientation of the ellipse of the shaft shown in FIG. 2 is defined by a major axis designated A-1, and a minor axis, A-2. The major axis A-1 is the larger axis that runs in the direction of the largest dimension of the ellipse and bisects the ellipse. The minor axis A-2 is perpendicular to the major axis and also bisects the ellipse. FIG. 2 shows that the major axis A-1 can be aligned approximately perpendicular to the clubface 28.

This orientation has the advantage that the smaller radius of curvature provided by the leading edge 34 of the shaft reduces the air drag on the shaft as the golf club 20 is swung into the impact area.

Figure 5:
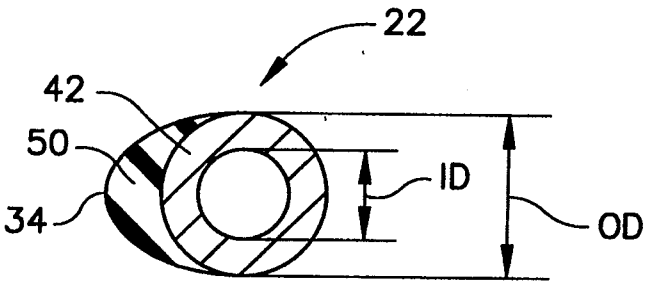
FIGS. 4–7 are cross sectional views of several alternative embodiments of the golf club shaft of the present invention which have non-circular cross sections.
Figure 7:
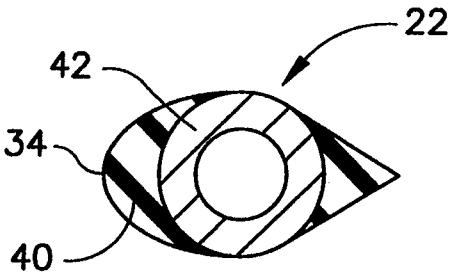

In alternative embodiments, the shaft 22 may be of some other cross sectional shape. For example, as shown in FIG. 5, the exterior cross section of the improved golf club shaft of the present invention need not be elliptical. Other suitable aerodynamic shapes (such as the tear-shaped cross section of the shaft shown in FIG. 7) can also be used. The key to these embodiments is that at least a portion of the leading edge 34 of the shaft 22 has a smaller radius of curvature than the leading edge of a shaft having an equivalently sized circular cross section. This provides the shaft with an aerodynamic leading edge 34.

The phrase "equivalently sized circular cross section", as used herein, refers to shafts having a circular cross section with an outside diameter (shown as "OD" in FIG. 5) equal to the smallest outside dimension of the shaft of the present invention. For example, an equivalently sized shaft to the shaft of the present invention shown in FIG. 2 is a circular shaft that has a diameter equal to the length, l, of the minor axis of the ellipse. The shaft of the present invention may also have a leading edge with a smaller radius of curvature than circular shafts with a smaller diameter than the smallest outside dimension of the shaft of the present invention. In particular, the leading edge 34 should have a radius of curvature of about 0.47 cm at the tip and less than about 0.8 cm at the butt conventional golf club shafts having circular cross sections such as any of those manufactured by Aldila, Inc., or manufactured under the tradename of True Temper. In addition, although the leading edge 34 is described as having a "radius of curvature", the shaft of the present invention is not limited to shapes having cross sections defined strictly by curvilinear segments. It is within the scope of the present invention for the cross section of the leading edge 34 to be formed by rectilinear segments, curvilinear segments, or both.

The cross sectional shape of the shaft 22 can be constant down the length of the shaft, or it can vary down the length of the shaft. The cross section can vary in the alignment of the axes of the ellipses and/or the size of the ellipses. The cross sectional shape of the shaft could, for example, be used to reduce drag on the shaft when it is in different positions during the golfer's swing, to bring the golfer's swing into impact on a certain swing path, or both. For instance, the shaft 22 can have the cross section shown in FIG. 3 near the grip 24. The cross section of the portion of the shaft near the grip is oriented to reduce wind resistance when the golfer is pulling the club into the ball on the way down from the top of the swing. The portion of the shaft having the cross section shown in FIG. 2 could then serve to assist the golfer in moving the club into the impact zone by minimizing drag and squaring the clubface.

The shaft 22 is preferably constructed so that any variations in the cross section of the shaft 22 are gradual so that there is a smooth transition along the shaft between such different cross sections. In addition, the shaft 22 of the present invention can be provided with a series of "step downs" similar to current golf club shafts.

Figure 3:
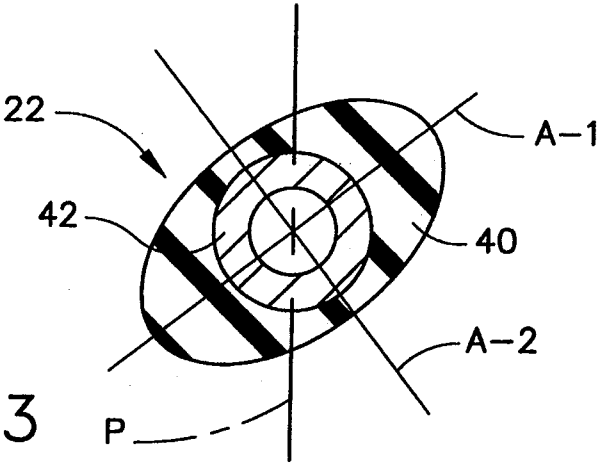
FIG. 3 is a cross sectional view of the golf club shaft of the present invention taken along line 3—3 of FIG. 1.

The aerodynamic golf club shaft 22 of the present invention can be created in a number of different ways. FIGS. 2 and 3 show embodiments in which the shaft 22 is created by slipping a hollow tube or sheath 40 onto a standard golf club shaft (or circular shaft having a smaller than standard diameter) 42. The sheath 40 has interior walls 46 and exterior walls 48 that define a circular interior cross section and an elliptical exterior cross section.

The sheath 40 can be held in place by fitting snuggly over the circular shaft 42 (i.e., friction fit), or it can be affixed to the circular shaft. The sheath 40 can be affixed to the circular shaft 42 with an adhesive similar to that used to affix the grip 24 to the shaft 22, or by the method used to affix the plastic tube to the aluminum tube in U.S. Pat. No. 5,094,454 issued to Schering.

The sheath 44 is preferably compressible (and/or deformable) to permit flexing of the shaft 22 and to provide the same flexibility in all directions. The sheath 40 is preferably also resilient so that it returns to its original shape after it is compressed through bending or twisting. A suitable type of material useful as the sheath 40 is a compressible rubber material.

Preferably, the sheath 40 also comprises (or is coated with) a material that has a low coeffecient of drag so that it will have a reduced tendency to be affected by air drag or wind resistance when the club is swung. A suitable material that has a low coefficient of drag that might be useful for the sheath is the material (or some suitable variation of the same) used in the swimsuits of the U.S. Olympic athletes in the 1992 Olympics which has a reduced drag in water.

Other suitable materials include, but are not limited to polyolefins, and plastics such as the material used in the golf clubs described in U.S. Pat. No. 5,094,454 issued to Schering, U.S. Pat. No. 4,936,582 issued to Bernstein, and U.S. Pat. No. 4,326,716 issued to La Coste. (Of course, in the present invention, the entire shaft must be capable of performing similarly to or better than current shafts in bending and twisting when the golf club 20 is used to strike a golf ball, and should not deform like the novelty shafts described in some of the above patents.)

Figure 4:
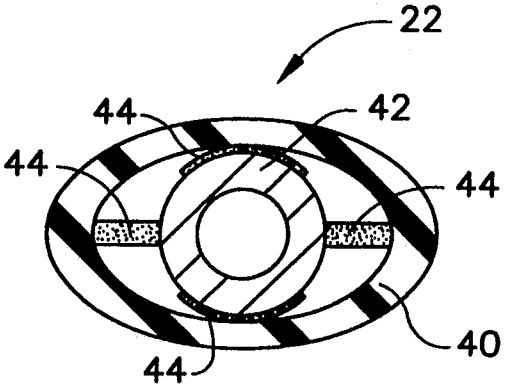

FIG. 4 shows an alternative embodiment in which the shaft 22 of the present invention is created by connecting a sheath 40 such as the one described above to a shaft 42 having a circular cross section by fasteners 44 that are located at points spaced equally radially around the shaft having the circular cross section. The fasteners 44 can be adhesive fasteners in the form of spots, lines, etc. The fastening of the sheath 40 to the shaft 42 in this embodiment provides the advantage that it allows the circular shaft 42 to serve as the load bearing structural member of the composite shaft. The circular shaft 42 bends and twists like a conventional golf club shaft. The sheath 40 does not interfere with the functioning of the circular shaft 42 due to the equal spacing of the fasteners which bond the two components. In other embodiments, the sheath (or other material affixed to the circular shaft) 40 can be used to reinforce the circular shaft 42 so that a circular shaft of lesser cross section can be used.

FIG. 5 shows an embodient in which the shaft 22 of the present invention is created by adhering a material 50 to the leading edge 34 of a shaft 42. The material can be any of the materials specified above as being suitable for use as the sheath. This embodiment has the advantage of providing an areodynamic leading edge with lesser material (and, thus, lesser weight) than embodiments that use sheaths to completely surround a shaft.

The shafts 42 having the circular cross sections that are used in the alternative embodiments described above can be a standard shaft, or it could be a smaller diameter shaft of some suitable type. The shaft 42 with the circular cross section can be made of any of the materials currently used in the construction of golf club shafts. These materials include, but are not limited to: steel, aluminum, graphite, boron, carbon, or combinations of these and other suitable materials.

Figure 6:
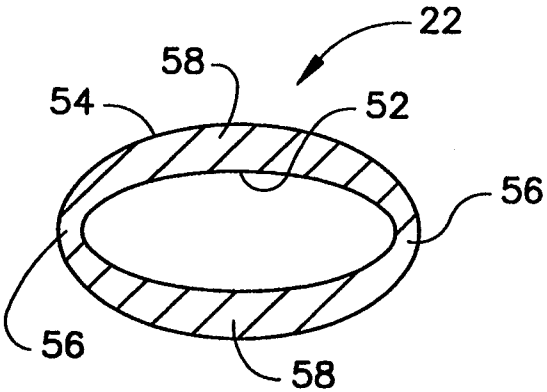

FIG. 6 shows an embodiment in which the shaft 22 of the present invention is created by constructing an elliptical (or other suitable cross sectional shape) shaft with interior walls 52 and exterior walls 54 having different wall thicknesses between its interior and exterior walls. The wall thicknesses are provided such that the portions of the shaft having the largest cross sectional dimension (the first portions 56 of the shaft) have thinner walls than those second portions 58 of the shaft with smaller cross sectional dimensions. The wall thicknesses are used to equalize the bending and twisting properties of the shaft in both directions.

The above methods of making the cross section of the shaft 22 elliptical (or otherwise non-circular) are believed to keep the flexibility and twisting properties of the shaft 22 the same in all directions.

Figure 8A:
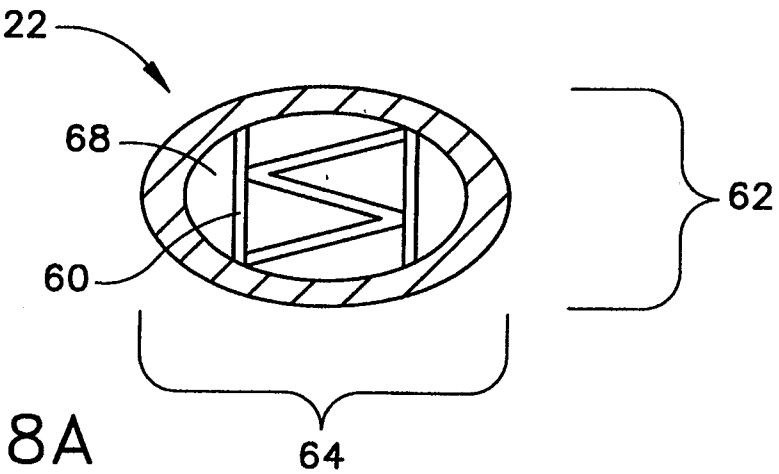
FIGS. 8 and 8A are cross sectional views of alternative embodiments of the present invention that have an internal truss-like structures.
Figure 8:
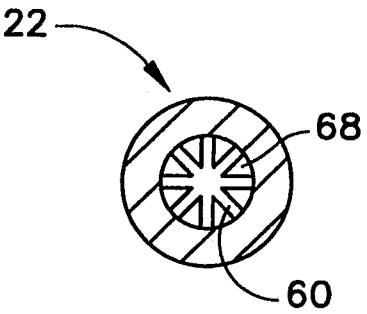

FIGS. 8 and 8A are cross sectional views of alternative embodiments of the present invention that have a hollow cross section that provides a tunnel 68 and an internal truss-like reinforcing structures 60 in the tunnel 68. The internal truss-like structure 60 preferably extends from one side of the interior wall of the shaft to the opposite side. The internal truss-like structure 60 of the shaft shown in FIG. 8 may be used to provide the shaft with enough strength so that the shaft can be made with a smaller exterior cross section (and, thus, more areodynamic). This truss-like structure 60 can also be used to make a lightweight shaft having sufficient strength with thinner walls than conventional shafts.

The internal truss-like structure 60 of the shaft shown in FIG. 8A is used for a different purpose. This internal truss-like structure 60 (or some variation of the same) is used to equalize the bending and flexing properties of the shaft in both directions as an alternative to varying the wall thickness of a non-circular shaft. The truss 60, in essence, reinforces the narrower portions of the shaft (the portions of the shaft having the smallest exterior dimension) 62, and provides the narrower portions 62 of the shaft with the same twisting and bending properties as the wider portions 64 of the shaft.

Figure 10:
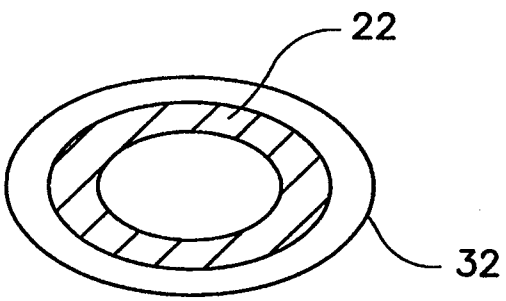
FIG. 10 is a cross section taken along line 10—10 of FIG. 1 of a golf club having a shaft and hosel both of which have elliptical cross sections.
Figure 9:
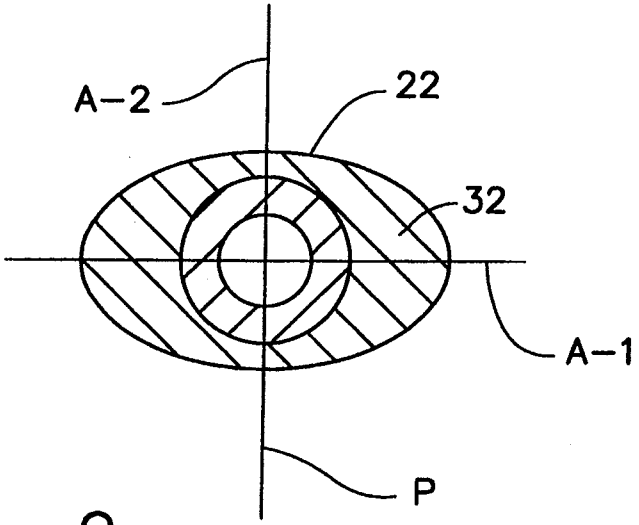
FIG. 9 is a cross section taken along line 9—9 of FIG. 1 of a golf club having a shaft with a circular cross section and a hosel with an elliptical cross section.

FIGS. 9 and 10 are cross sections of a hosel 32 and shaft 22 of an alternative construction in which the hosel, the shaft, or both, have an areodynamic cross section. The cross sectional shape of these components can be any of the cross sections described above as being suitable for the shaft.

FIG. 9 shows a shaft 22 having a circular cross section that is inserted into a club having a hosel 32 with an improved, areodynamic elliptical cross section. The circular cross section of the shaft allows the shaft to have the same bending and twisting properties in each direction while the shape of the hosel 32 is able to create a reduction in the overall air drag on the golf club. In addition, the hosel 32 can be made thinner and lighter because it is believed that the majority of the stresses exerted on the hosel 32 when the club is used to strike a golf ball is in the direction of the major axis of the elliptical hosel. The larger major axis of the hosel 32 is reinforces the hosel against these stresses.

FIG. 10 is a cross section of a shaft 22 and hosel 32, both of which have elliptical cross sections. The embodiment shown in FIG. 10 is used with shafts having the improved areodynamic shape of the embodiments described above. The elliptical cross section of the shaft reinforces the lower portions of the shaft against stresses and allows the shaft and hosel to be made thinner and elliptical to reduce drag.

In an alternative embodiment, the shaft can have a circular cross section where it enters the hosel and an elliptical cross section at all points below. The portion of the shaft having a circular cross section is the uppermost portion of the shaft that is affixed to the hosel. This, thus, is the portion of the shaft that the rest of the shaft twists and bends around. The portion of the shaft provided with a circular cross section is, therefore, used to equalize the bending and twisting properties of the shaft.

A futher consideration in the design of the golf club shaft of the present invention is the cross section of the portion of the shaft that is inserted into the grip 24 of the golf club 20. The cross section of the grip 24 must be circular to conform to USGA specifications. To meet this requirement, the portion of the shaft 22 that is inserted into the grip 24 could be circular (while the exposed portion 66 of the shaft is elliptical, etc.). Alternatively, the shaft 22 can have an elliptical cross section at the grip end 20B, and the grip 24 could have an elliptical interior cross section and a circular exterior cross section so that it will fit closely over the shaft and provide a grip 24 with a circular cross section.

The disclosures of all patents and publications mentioned throughout this patent application are hereby incorporated by reference herein. It is expressly not admitted, however, that any of the documents incorporated by reference herein teach or disclose the present invention. It is also expressly not admitted that any of the commercially available materials or products described herein teach or disclose the present invention.

While particular embodiments of the present invention have been illustrated and described, it would be obvious to those skilled in the art that various other changes and modifications can be made without departing from the spirit and scope of the invention.

What is claimed is:

1. An aerodynamically shaped golf club shaft having a longitudinal axis, a non-circular exterior cross section, a leading edge, and a trailing edge, wherein the leading edge of said shaft has a radius of curvature that is less than about 0.47 cm at the tip and less than about 0.8 cm at the butt and said aerodynamically shaped shaft is provide with a means for equalizing its bending and twisting properties so that said shaft bends in such a way that the deflection of said shaft is the same regardless of how the shaft is rotated about its longitudinal axis, and said shaft twists with respect to its longitudinal axis the same amount in both the clockwise and counterclockwise directions.

2. A golf club shaft according to claim 1 wherein the leading edge of said shaft comprises a compressible and resilient material, and said material is more compressible and flexible than steel.

3. A golf club shaft according to claim 1, said shaft being hollow, and having exterior walls and interior walls which define a wall thickness therebetween, said shaft having a single cross section comprising:

first portions that have a first dimension between opposite portions of said exterior walls, and second portions that have a second smaller dimension between opposite portions of said exterior walls, wherein said first portions have a first wall thickness and said second portions have a second wall thickness that is less than said first wall thickness.

4. A golf club shaft according to claim 1 comprising a tube having exterior walls and interior walls, said interior walls defining a tunnel therebetween, said shaft having a reinforcing truss structure in said tunnel, said truss structure being asymmetrical about said longitudinal axis and reinforcing said tube so that said bending and twisting properties are maintained.

5. An aerodynamically shaped golf club shaft having a longitudinal axis, a non-circular exterior cross section, a leading edge, and a trailing edge, wherein the leading edge of said shaft has a radius of curvature that is less than about 0.47 cm at the tip and less than about 0.8 cm at the butt comprising a hollow shaft of circular cross section having a sheath with an elliptical cross section fit around the outside of said circular shaft wherein said shaft with the circular cross section has a flexibility and said sheath has a higher flexibility than said shaft, and said aerodynamically shaped shaft ends in such a way that the deflection of said shaft is the same regardless of how the shaft is rotated about its longitudinal axis, and said shaft twists with respect to its longitudinal axis the same amount in both the clockwise and counterclockwise directions.

6. The golf club shaft of claim 5 wherein said sheath comprises a compressible and resilient material.

7. The golf club shaft of claim 6 wherein the sheath is held onto said circular shaft by friction.

8. The golf club shaft of claim 6 wherein said sheath has interior walls and exterior walls which define a wall thickness therebetween, wherein said sheath has portions of the same cross section with different wall thicknesses and said sheath is secured to said circular shaft by a bonding material.

9. An aerodynamically shaped golf club shaft having a longitudinal axis, a non-circular cross section, a leading edge, a trailing edge, said cross section being defined by a major axis and a minor axis, a dimension measured along said major axis, and a dimension measured along said minor axis that is less than said dimension measured along said major axis, wherein the leading edge of said shaft has a radius of curvature that is less than one half of the dimension of said cross section measured along said minor axis, and said golf club shaft comprises a hollow shaft of circular cross section having a sheath with an elliptical cross section fit around the outside of said circular shaft, said sheath being comprised of a compressible and resilient material which is secured to said circular shaft by bonding material at a series of points that are spaced radially around said circular shaft and said aerodynamically shaped shaft bends in such a way that the deflection of said shaft is the same regardless of how the shaft is rotated about its longitudinal axis, and said shaft twists with respect to its longitudinal axis the same amount in both the clockwise and counterclockwise directions.

* * * * *